US006309542B1

(12) United States Patent
Kim

(10) Patent No.: US 6,309,542 B1
(45) **Date of Patent: *Oct. 30, 2001**

(54) WASTE WATER TREATING DEVICE

(76) Inventor: Seung-Wook Kim, 590-4, Sam-ri, Silchon-myeon, Kwangju-koon, Kyungki-do (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/975,807

(22) Filed: Nov. 21, 1997

(30) Foreign Application Priority Data

Dec. 2, 1996 (KR) ..... 96-45644
Aug. 2, 1997 (KR) ..... 97-21385

(51) Int. Cl.[7] ..... B01D 35/06; F23G 5/08

(52) U.S. Cl. ..... 210/222; 210/180; 210/181; 210/386; 210/528; 110/216; 110/236; 110/238; 110/242; 110/250; 110/255; 110/259

(58) Field of Search ..... 210/175, 180, 210/222, 181, 528, 523, 386; 110/229, 235, 236, 221, 203, 204, 216, 243, 255, 259, 258; 159/16.1, 47.3; 203/11, DIG. 14; 100/121

(56) References Cited

U.S. PATENT DOCUMENTS 2,812,212 * 11/1957 Rogers et al. .
3,623,977 * 11/1971 Reid ..... 210/12
3,762,549 * 10/1973 Crampton ..... 210/123
3,875,357 * 4/1975 Foster et al. .
4,069,143 1/1978 Friesenborg et al. .
4,137,174 * 1/1979 Spodig ..... 210/222
4,142,970 3/1979 von Hagel et al. .
4,157,961 * 6/1979 Borst ..... 210/33
4,268,388 * 5/1981 Romeo ..... 210/180
4,367,145 1/1983 Simpson et al. .
4,482,458 11/1984 Roval et al. .
4,505,813 3/1985 Graves .
4,526,687 7/1985 Nugent .
5,188,742 * 2/1993 Shurtleff ..... 210/774
5,913,273 * 6/1999 Maejima .

* cited by examiner

*Primary Examiner*—W. L. Walker
*Assistant Examiner*—Marianne Ocampo
(74) *Attorney, Agent, or Firm*—Darby & Darby

(57) ABSTRACT

A waste water treating device can be simply installed in a small area and destroy combustible wastes and sludge to reduce fuel consumption cost of a burner. Moreover, the waste water treating device can increase a treating amount of the waste water per unit time to thereby reduce an activation time thereof and decrease installation and maintenance cost, to thereby obtain an economic advantage.

The waste water treating device includes: a treater( 10) having a burner (13) which evaporates waste water and destroys by fire sludge contained within the waste water, if the waste water ejected through nozzles (32) flows to a combustion chamber (12) and combustible general wastes are inserted through an insertion hole (111); a supplier (20) which supplies the waste water from a collecting tank to the treater (10), an ejector (30) which ejects the waste water supplied from the supplier (20) to the treater (10), and a dust collector (40) which is connected to an ejecting hole (113) of the treater (10), for collecting dusts contained within exhaust gas ejected from the treater (10).

5 Claims, 5 Drawing Sheets

WASTE WATER TREATING DEVICE

TECHNICAL FIELD

The present invention relates to a waste water treating device, and more particularly, to a waste water treating device which can treat waste water containing waste printing ink which is generated from a printing factory, or waste water containing a variety of oil such as lubricating oil which is generated from a general factory.

BACKGROUND ART

Generally, in a printing factory all kinds of printing products are manufactured by using water or oil ink, and therefore waste water containing waste ink is generated. Further, even lubricating oil may be contained in the waste water due to activation of printing machines.

Meanwhile, the generation of the waste water containing the oil is not excluded in a general factory which machines is worked.

To prevent pollution of environment due to discharge of waste water out of factory, there is provided a conventional device which filters or purifies waste ink or oil contained in the waste water by using a filtering method by means of a filter, a sewage purification method, or a sedimenting method with medicines.

However, in the conventional device using the filtering method with the filter, if the filter through which a variety of sludge such as a waste ink particles, oil particles and so on is filtered is waste without any treatment, the filtered waste water is restored to its original waste water in the case where water is admixed to the wasted filter. Therefore, there is an inconvenience in that the completely used filter should be destroyed by fire.

Also, in the conventional device using the sedimenting method with medicines there are problems in that a purification cost is increased due to expensive medicine usage and a sediment should be re-treated. Additionally, if the treated water with the medicines is directly discharged, there occurs a problem in that river contamination is naturally accompanied since the treated water is short of the biological oxygen demand (BOD).

Due to an illegal exhaust of factory waste water, the waste water flows to general sewage or rivers to deteriorate soil or the water quality, which results in a serious destruction of natural environment.

DISCLOSURE OF INVENTION

An object of the present invention is to provide a waste water treating device which can completely prevent generation of contamination of natural environment caused due to factory waste water in order to be free from the above-mentioned problems.

Another object of the present invention is to provide a waste water treating device which can be installed in a small area and reduce installation and maintenance cost thereof.

To achieve these and other objects according to the present invention, there is provided a waste water treating device including: a treater which destroys by fire sludge such as waste printing ink, waste oil and the like contained in waste water and evaporates the waste water; a supplier which delivers the waste water from a collecting tank to the treater; and an ejector which ejects the waste water supplied from the supplier to a combustion chamber within the treater. With the waste water treating device according to the present invention, since the sludge such as waste printing water or oil ink, lubricating oil, cutting oil and so on can be completely removed in the destruction by fire manner and the waste water is evaporated, a re-treatment process is separately not required and further a large installation area is not occupied.

Further, a waste water treating device according to the present invention includes a separator which electrically separates the sludge such as ink particles or oil particles contained in the waste water and a preheater which preheats the waste water before it is delivered to the treater.

If the waste water is supplied and ejected in the combustion chamber within the treater by the operation of the supplier and the ejector, the waste printing ink or waste oil contained in the waste water is destroyed by the frames of a burner which is mounted within the combustion chamber and the waste water is then evaporated. During the process, if the waste water is passed through the separator, the various kinds of sludge such as printing ink particles, waste oil particles and the like contained within the waste water is electrically separated from the waste water and directly puts in the combustion chamber. Next, since a low density of waste water from which the various kinds of sludge is filtered is delivered to the preheater and is then preheated to be ejected within the combustion chamber, the printing ink particles or the waste oil particles are immediately destroyed by fire and the water is rapidly evaporated, which results in a complete removal of the generation of environment contamination due to the factory waste water.

BEST MODE FOR CARRYING OUT THE INVENTION

Hereinafter, an explanation on the construction and operation of a waste water treating device constructed according to a first embodiment of the present invention will be in detail discussed with reference to FIGS. 1 and 2.

Figure 2:
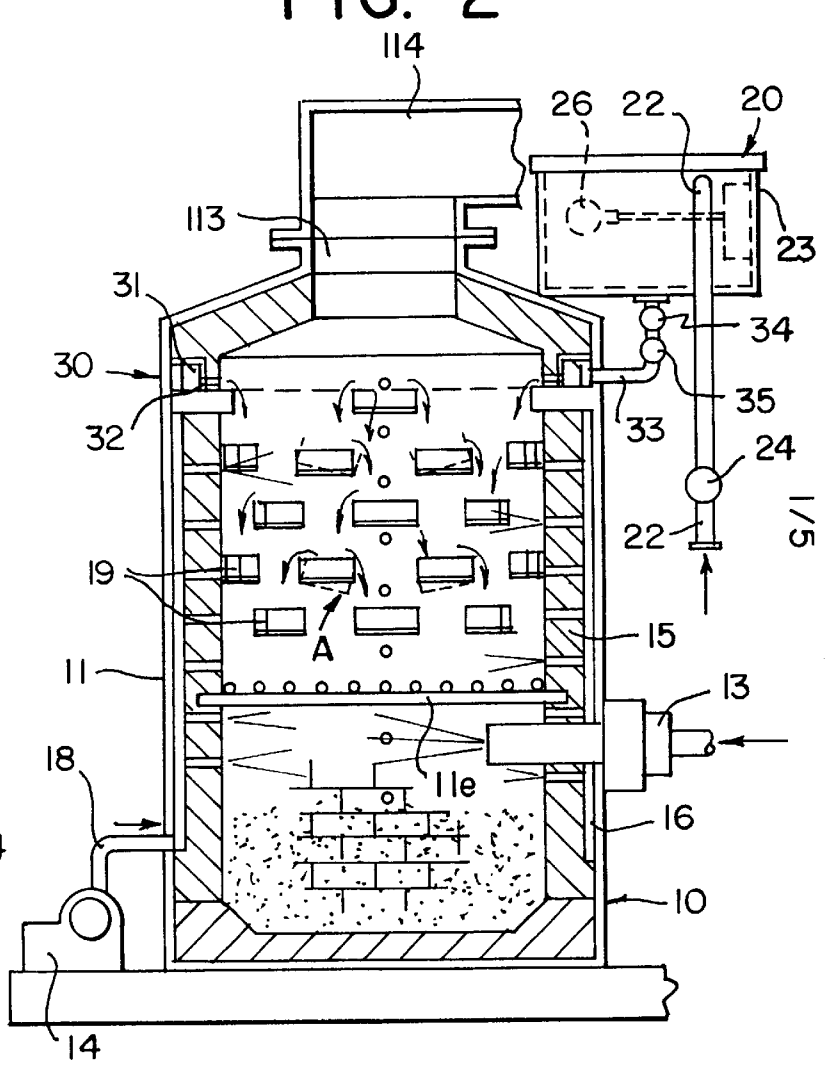
FIG. 2 is an enlarged sectional view illustrating main parts of FIG. 1.
Figure 1:
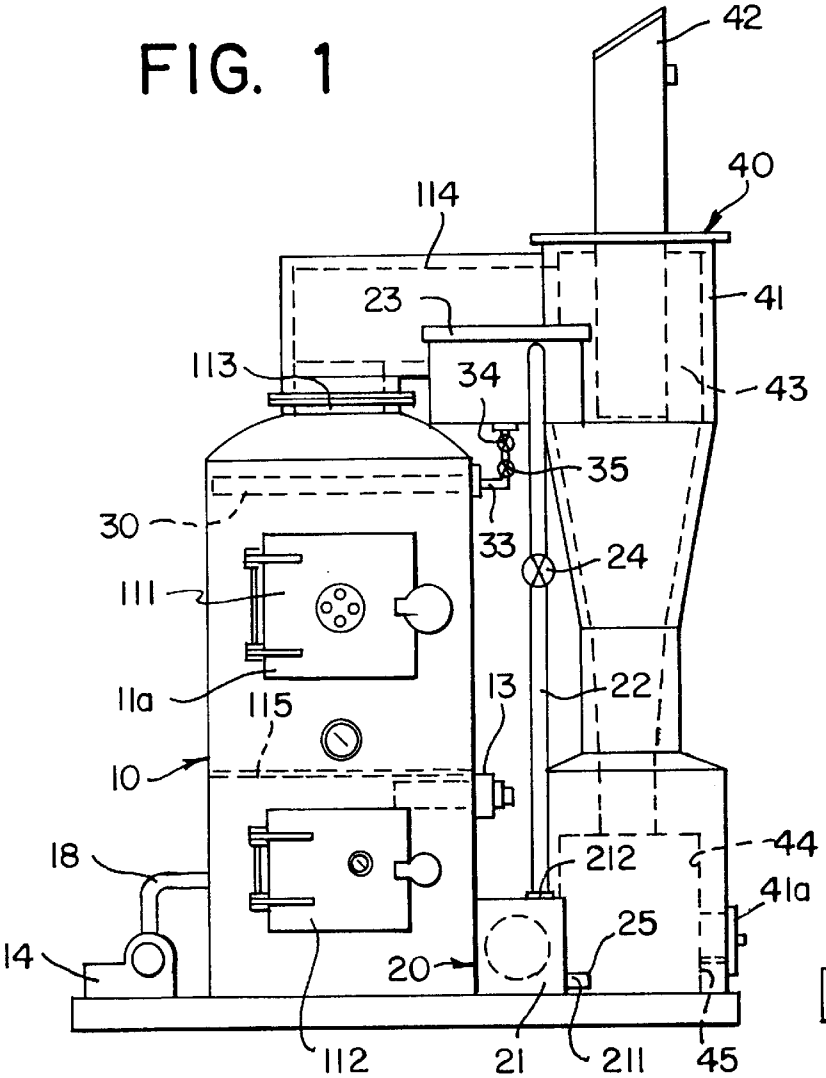
FIG. 1 is a top view illustrating a waste water treating device constructed according to a first embodiment of the present invention.
Figure 3:
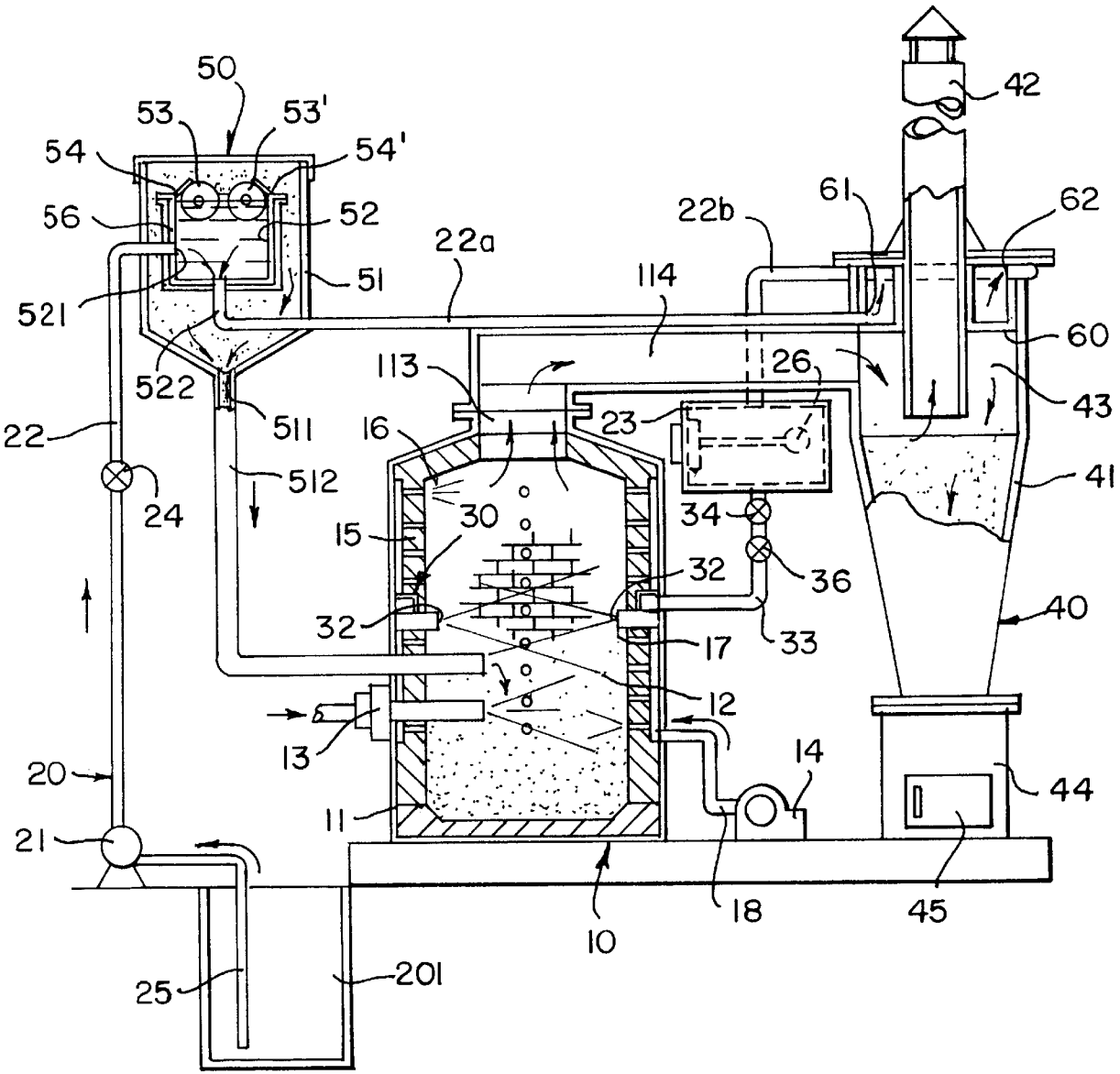
FIG. 3 is a partly sectional view illustrating a schematic construction of a waste water treating device constructed according to a second embodiment of the present invention.
Figure 4:
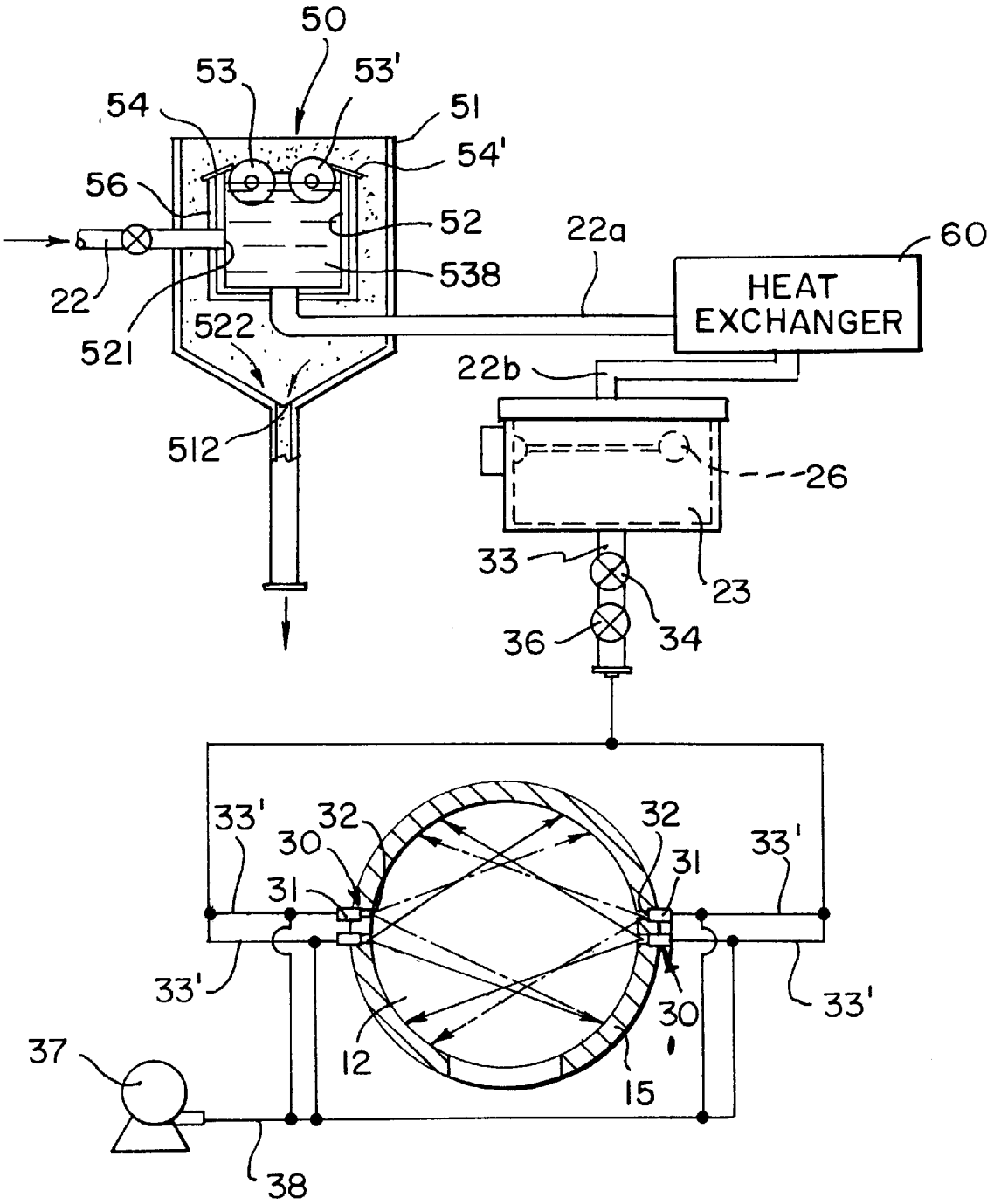
FIG. 4 is a view illustrating operational states of part components of FIG. 3.
Figure 5:
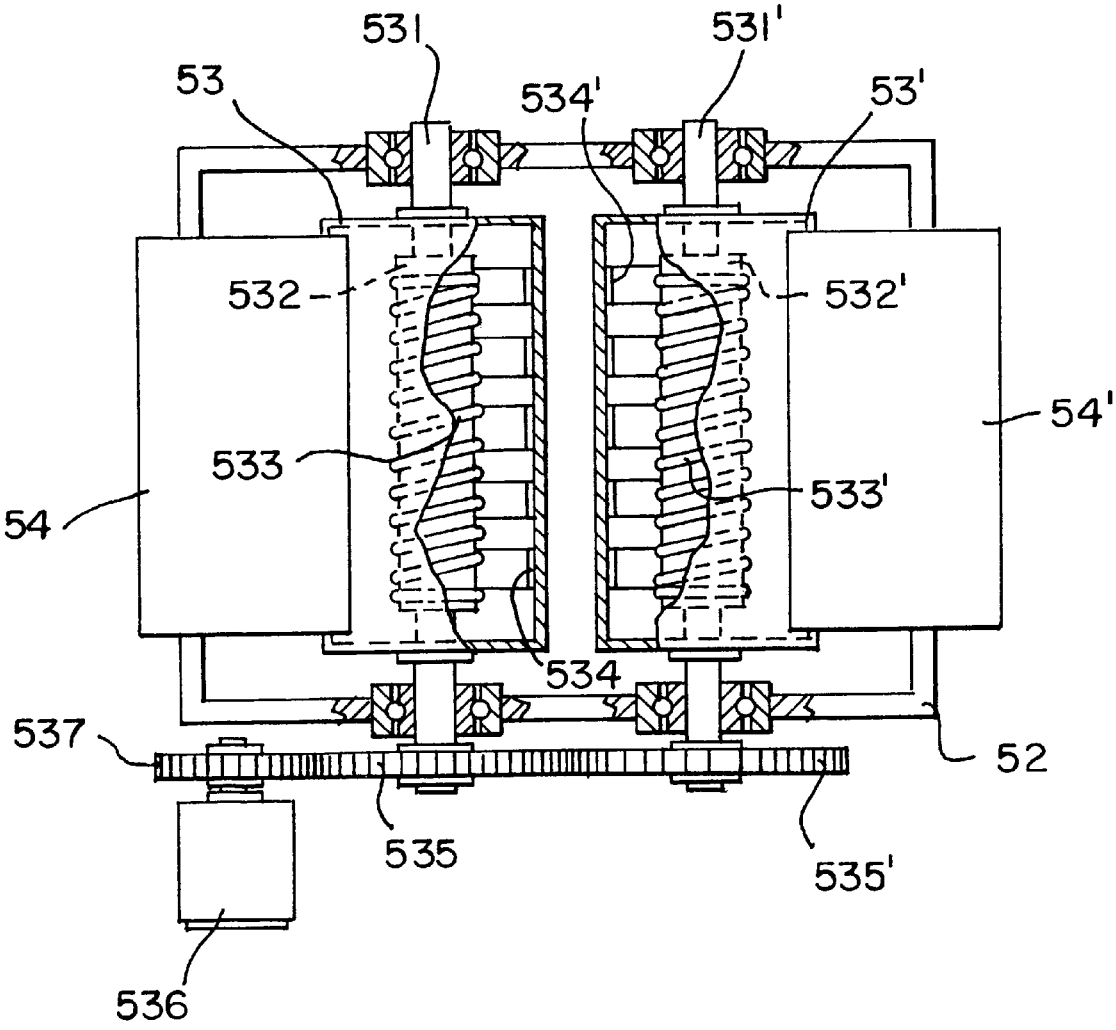
FIG. 5 is a partly taken and enlarged plan view illustrating the separating tank of FIG. 3.
Figure 6:
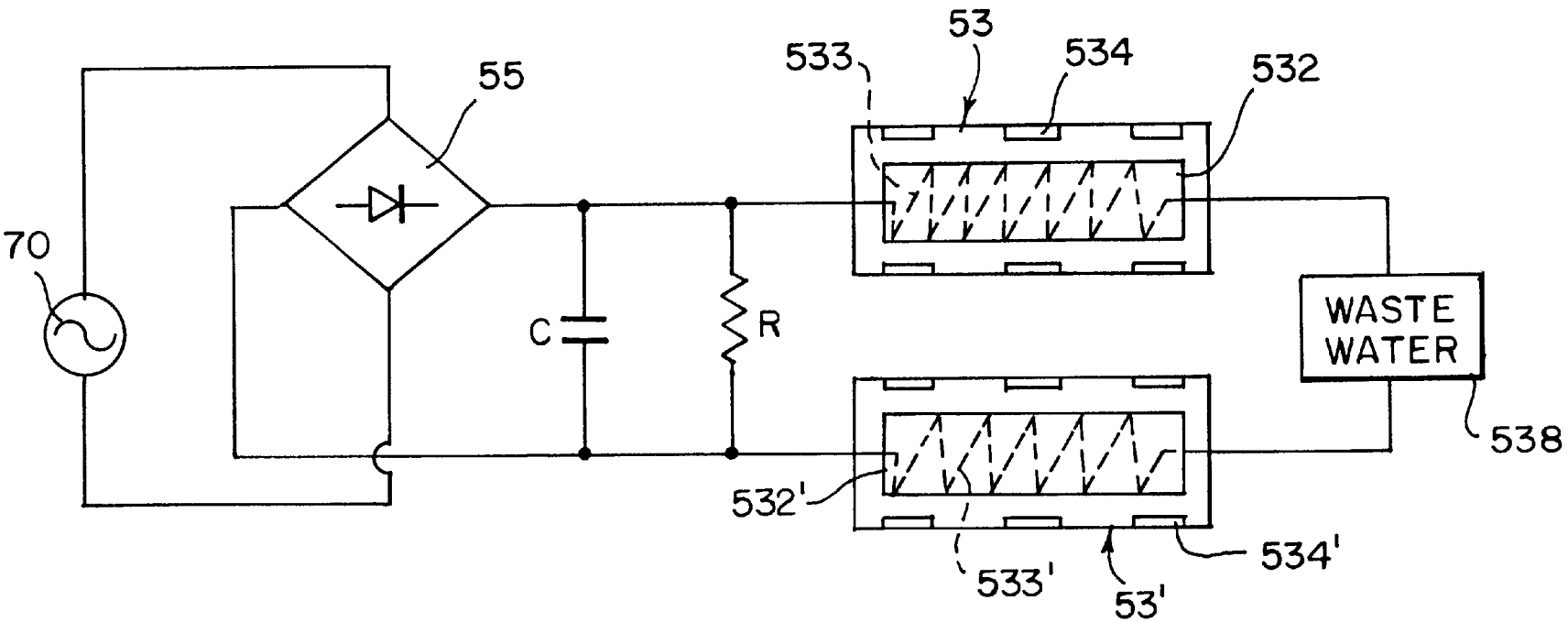
FIG. 6 is a circuit diagram illustrating the separating tank of FIG. 5.

Referring to FIGS. 1 and 2 showing a waste water treating device constructed according to a first embodiment of the present invention, there are provided a treater 10 which destroys by fire sludgy such as waste printing ink, waste oil and so on contained in waste water and evaporates the water remaining after the destruction by fire, a supplier 20 which supplies the waste water from a collecting tank to the treater 10, an ejector 30 which ejects the waste water supplied from the supplier 20 to the treater 10, and a dust collector which collects dusts contained within exhaust gas ejected from the treater 10 to prevent the dusts from being scattered to the exterior.

Preferably, the treater 10 is comprised of a gas cylinder 11, a combustion chamber 12 installed within the gas cylinder 11, a burner 13 mounted on a lower side portion of the combustion chamber 12, and a blower 14 for supplying external air within the combustion chamber 12.

On the upper portion of the front surface of the gas cylinder 11, an inserting hole 111 having an opened/closed door 11*a* is installed, through which combustible general wastes are inserted into the combustion chamber 12. And, on the lower portion of the front surface of the gas cylinder 11, a drawing hole 112 having an opened/closed door 11*b* is installed, through which burned ashes are taken out of the combustion chamber 12. Meanwhile, on the top end portion of the gas cylinder 11, an ejecting hole 113 is installed to eject the combustion air.

The combustion chamber 12 is installed to be surrounded with a fire-resisting wall 15 which is comprised of fire-resisting bricks piled up on the inner peripheral surface of the gas cylinder 11, and an air passage 16 is formed by an appropriate interval between the fire-resisting wall 15 and the gas cylinder 11. Further, a plurality of connecting holes 17 are installed by an appropriate interval on the fire-resisting wall 15 to connect the combustion chamber 12 with the air passage 16.

And, connection of the blower 14 with the air passage 16 is made by means of a blowing pipe 18.

Hence, if the blower 14 operates, external air is supplied via the blowing pipe 18 to the air passage 16 and finally flows into the combustion chamber 12 through the plurality of connecting holes. So, oxygen contained within the external air arrives at the combustion chamber 12 to facilitate the combustion operation thereof.

On the other hand, a plurality of guide projections 19, which are each comprised of a fire-resisting brick and are formed at a crossed position to each other in every directions, are protrudedly installed on the inner wall surface of the fire-resisting wall 15. In the case where a part of the waste water ejected within the combustion chamber 12 flows along the inner surface of the fire-resisting wall 15, the part of waste water is distributed in left and right directions by means of the guide projections 19, such that the waster water is widely distributed, while delaying the flowing speed of the waste water, to thereby activate the combustion and evaporation of the combustion chamber 12.

Of course, the plurality of guide projections 19 are horizontally protruded, but may be inclinedly protruded at an appropriate angle, as shown by a virtual line 'A' of FIG. 2.

The supplier 20 is preferably comprised of a pump 21, a storage tank 23 into which the waste water conveyed through a conveying pipe 22, and a check valve 24 which is mounted on the conveying pipe 22 to prevent the waste water from reversely flowing.

An induction hole 211 of the pump 21 is connected by means of an induction pipe 25 to the waste water collecting tank (not shown), and an ejecting hole 212 thereof is connected to the conveying pipe 22.

A flutter 26 is installed within the storage tank 23 to thereby control storage of an appropriate amount of waste water therein. Thus, if the waste water to be stored in the storage tank 23 reaches a proper water level, a switch (not shown) of the flutter 26 is turned "off", activation of the pump 21 stops, and contrarily, if the waste water is under the proper water level, the switch thereof is turned "on", the pump 21 operates to supply the waste water.

The ejector 30 is preferably comprised of receiving pipe bodies 31 which are mounted on the upper portion of the interior of the gas cylinder 11, and nozzles 32 are attached by appropriate intervals to the inner peripheral surfaces of the receiving pipe bodies 31, each of which has an inner end connected to the fire-resisting wall 15 and exposed to the combustion chamber 12.

The receiving pipe bodies 31 are connected via a supplying pipe 33 to the storage tank 23, and a check valve 34 and an adjusting valve 35 are each attached on the supplying pipe 33.

The check valve 34 serves to prevent the waste water supplied to the receiving pipe bodies 31 from reversely flowing, and the adjusting valve 35 serves to artificially adjust a supplying amount of the waste water.

In addition, a pump or a compressor (not shown) may be mounted on the supplying pipe 33 to forcedly eject the waste water to the combustion chamber 12 through the nozzles 32.

A chimney 114 connects onesurface of the upper side of a gas cylinder 41 of the dust collector 40 with an ejecting hole 113 of the gas cylinder 11, and an exhaust pipe 42, which has a diameter smaller than the gas cylinder 41, is mounted on the center portion of the sealed upper end surface of the dust collector 40 to be vertically passed through the dust collector 40.

Since the lower end of the exhaust pipe 42 is disposed at a lower position than the connected position of the chimney 114 and the gas cylinder 41, a circulating space 43 is formed between the inner peripheral surface of the upper portion of the gas cylinder 41 and the outer peripheral surface of the lower end portion of the exhaust pipe 42.

Therefore, since the combustion air flowing into the upper portion of the gas cylinder 41 through the chimney 114 is circulated at the circulating space 43 and then passes through the lower end of the exhaust pipe 42 to be exhausted to the outside, the dusts contained within the combustion air are dropped to the dust collecting chamber 44 formed in the lower portion of the gas cylinder 41 by its own tare force.

The collected dusts are taken out of a drawing hole 45 having an openable/closeable door 41*a* on the lower portion of the gas cylinder 41.

Now, an explanation of an operation of the waste water treating device constructed according to the first embodiment of the present invention will be discussed.

Firstly, the burner 13 of the treater 10 is ignited to heat the combustion chamber 12 up to an appropriate temperature, and then the pump 21 of the supplier 20 operates to convey the waste water collected within the collecting tank to the storage tank 23.

Next, the door 11*a* of the gas cylinder 11 of the treater 10 opens and the combustible wastes such as paper, lumber and so on are inserted within the combustion chamber 12 through the inserting hole 111. The general wastes are on the a roaster 115 and finally destroyed by the fire of burner 13.

At the time, since the interior of the combustion chamber 12 is maintained at the high temperature by the fire of the burner 13, the general wastes can be well burned, even if the roaster 115 is not mounted.

Next, if the blower 14 operates to supply the external air within the air passage 16, the external air flows to each of the connecting holes 17, and is supplied t the combustion chamber 12 to facilitate the combustion operation thereof.

Under the above state, if the adjusting valve 35 of the ejector 30 opens to supply the waste water within the storage tank 23 to the receiving pipe bodies 31, the waste water is ejected into the combustion chamber 12 through the nozzles 32 each attached on the inner peripheral surface of the receiving pipe bodies 31. At the time, the waste water is ejected by a compressing force of the pump or compressor in a mist shape from the upper portion of the combustion chamber 12. Alternatively, if the waste water flows naturally, it flows along the inner surface of the fire-resisting wall 15.

Since the waste water flowing along the inner surface of the fire-resisting wall 15 is distributed in left and right directions by means of the guide projections 19 protruded on the inner surface of the fire-resisting wall 15, the waste printing ink or the waste oil contained within the waste water is rapidly burned by the heated fire-resisting wall 15 and the fire of burner 13 and even the water remaining after the burning is finally evaporated.

The ashes generated during the combustion are dropped to the lower portion of the gas cylinder 11, and the evaporated steam is ejected to the dust collector 40 through the ejecting hole 113 and the chimney 114, along with the exhaust gas.

Then, the exhaust gas flowing to the upper portion of the dust collector 40 is circulated in the circulating space 43 and passes through the lower end of the exhaust pipe 42 to be exhausted to the outside through the exhaust pipe 42. During the process, the dusts contained within the exhaust gas are dropped to the dust collecting chamber 44 formed in the lower portion of the gas cylinder 41 by its own tare force.

FIGS. 3 to 6 show a waste water treating device constructed according to a second embodiment of the present invention. In the same manner as the first embodiment of the present invention, in the second embodiment of the present invention there are provided a treater 10 which destroys by fire sludgy such as waste printing ink, waste oil and so on contained in waste water and evaporates the water remaining after the destruction by fire, a supplier 20 which supplies the waste water from a collecting tank to the treater 10, an ejector 30 which ejects the waste water supplied from the supplier 20 to the treater 10, and a dust collector which collects dusts contained within exhaust gas ejected from the treater 10 to prevent the dusts from being scattered to the exterior.

Further, the waste water treating device constructed according to the second embodiment of the present invention includes a separator 50 which separates and collects various sludge such as waste printing ink particles or an oil particles contained in the waste water to directly supply the process waste water to the treater 10 before the supplier 20 supplies the waste water to the ejector 30, and a heat exchanger 60 which heat-exchanges and preheats a low density of waste water from which the sludge is removed with the heat of exhaust gas ejected from the treater 10 and delivers the preheated waste water to the ejector 30.

Preferably, the separator 50 is comprised of a collecting tank 51, a separating tank 52 mounted separatably within the collecting tank 51, separating rollers 53 and 53' installed rotatably within the upper end portion of the separating tank 52, and blades 54 and 54' for scratching the sludge attached on the separating rollers 53 and 53' to drop the scratched sludge to the collecting tank 51.

The bottom surface of the collecting tank 51 is formed in a downward inclined manner towards the center portion thereof. A flowing hole 511 of the center portion of the collecting tank 51 is connected to the top end of a supplying pipe 512, and the bottom end of the supplying pipe 512 is formed to be positioned at the upper side of a burner 13 within the combustion chamber 12 of the treater 10.

Accordingly, the sludge collected in the collecting tank 51 directly flows within the combustion chamber 12 by means of the supplying pipe 512 and is then burned therein.

The separating tank 52, which is mounted separatably within the collecting tank 51, is formed in a smaller size than the collecting tank 51. An inflowing hole 521 of the one side of the separating tank 52 is connected to one end of a conveying pipe 22 of the supplier 20, and an outflowing hole 522 of the bottom surface thereof is connected to one end of a conveying pipe 22*a* for conveying a low density of waste water flowing from the outflowing hole 522 to the heat exchanger 60.

The separating rollers 53 and 53' each take a form of a cylindrical body having a cavity in the interior thereof, which are each comprised of shafts 531 and 531' mounted to be crossedly passed through the interior thereof, cores 532 and 532' each attached to the shafts 531 and 531' to be placed on the interior of the cavity, and carbon brushes 534 and 534' mounted by appropriate intervals on the inner peripheral surfaces of the separating rollers 53 and 53'.

The separating rollers 53 and 53' are installed rotatably by means of the shafts 531 and 531' on the upper end portion of the separating tank 52 and have their lower portions which are under the waste water within the separating tank 52. Each one end of the shafts 531 and 531' is engaged with gears 535 and 535', and the gear 535 is engaged with a gear 537 mounted on a shaft of a motor 536.

If the motor 536 is driven, the driving force of the motor 536 is transmitted by the gear 537 to the gears 535 and 535', to thereby rotate the separating rollers 53 and 53'.

Accordingly, one coil 533 of coils 533 and 533' is connected to a positive (+) terminal of a bridge rectification circuit 55, and the other coil 533' is connected to a negative (−) terminal thereof.

If an alternating current power 70 is conductive, the alternating current power is rectified by the bridge rectification circuit 55, and ripple components contained in the rectified alternating current power are smoothed by a capacitor C and a resistor R and are then transmitted to each of the coils 533 and 533'.

Since each of the coils 533 and 533' generates a magnetic force, the separating rollers 53 and 53' become an electromagnet, such that negative (−) particles of the sludge contained in the waste water 538 are attached to the separating roller 53 and positive (+) particles of the sludge are attached to the separating roller 53'.

Since the sludge contained in the waste water 538 within the separating tank 52 is attached to the separating rollers 53 and 53' of the electromagnet, respectively, it is electrically separated from the waste water 538.

The blades 54 and 54', which are mounted on the upper ends of both sides of the separating tank 52, have the inner ends which are in almost contact with the outer peripheral surfaces of the separating rollers 53 and 53' and have the outer ends which are installed to be downwardly inclined to be exposed to the outside of the separating tank 52.

When the separating rollers 53 and 53' are rotated, the sludge attached on the outer peripheral surfaces thereof are scratched by the inner ends of the blades 54 and 54' and then passes through the upper surfaces of the blades 54 and 54' to be dropped within the collecting tank 51.

At the time, since the sludge particles collected in the collecting tank 51 is watery, they are poured into the combustion chamber 12 through the outflowing hole 511 and the supplying pipe 512 of the collecting tank 51.

The heat exchange 60, which takes a form of a cylindrical body having an inflowing hole 61 and an outflowing hole 62, is installed on the upper side portion within the circulating space 43 of the dust collector 40.

The inflowing hole 61 is connected to the other end of the conveying pipe 22*a,* and the outflowing hole 62 is connected by means of the conveying pipe 22*b* to a storage tank 23 in which a flutter 26 is installed.

Hence, after the low density of waste water from which the sludge is separated and removed from the separating tank 52 flows within the heat exchanger 60 and absorbs heat from exhaust gas ejected to the dust collector 40 through a chimney 114 and then preheated, the preheated waste water is delivered to the storage tank 23 and ejected within the combustion chamber 12 by the ejector 30.

On the other hand, in the second embodiment of the present invention the low density of waste water is delivered to the storage tank 23 through the heat exchanger 60, but may be delivered to the heat exchanger 60 through the separator 50 and the storage tank 23 and then preheated to be conveyed to the ejector 30 or may be delivered to the heat exchanger 60 through the storage tank 23 and the separator 50, which is not of course deviated from the scope of the invention.

In addition, in the second embodiment of the present invention two ejector pairs 30 are formed in upper and lower directions to be faced to each other on the intermediate portion of the gas cylinder 11 of the treater 10, each of which has a nozzle 32 having a crossed horizontal or upward ejecting direction.

And, a pump 36 is mounted on a passage of a supplying pipe 33, and the waste water is ejected through each of nozzles 32, as the pump 36 is operated.

At the time, since the waste water is ejected in a misty shape, the water is rapidly evaporated and the remaining sludge is well burned.

In this case, since the ejected waste water is crossed and bumped against each other, an eddy flow phenomenon occurs and therefore since the waste water is widely distributed due to the eddy flow phenomenon, the combustion and evaporation operations can be greatly improved with the fire of the burner 13 and the heat of the fire-resisting wall 15.

Furthermore, the ejectors 30 are connected to the inner ends of branch pipes 33' pipe-arranged on the end portions of the supplying pipe 33 and are directly supplied with the waste water by the branch pipes 33.

Accordingly, when compared with the first embodiment of the present invention, in the second embodiment of the present invention the installation of the receiving pipe bodies 31 are not needed within the gas cylinder 11.

And, a pouring pipe 38 of compression air is connected to each of the branch pipes 33', and the compression air is poured by means of a compressor 37.

Pouring the compression air prevents the branch pipes 33' having a relative small aperture from being blocked as well as increases an ejecting force of the waste water through the nozzles 32.

Hence, there is no need to install the pump 36 on the supplying pipe 33, when using the compressor 37, and if installed, the pump 36 may be used with the compressor 37 or selectively used.

The compressor 37 may be of course used by one installed in other device within the factory.

Meanwhile, heaters 27 and 56 are each installed in the storage tank 23 and the separating tank 52 to thereby prevent them from being frozen in the winter.

Now, an explanation of an operation of the waste water treating device constructed according to the second embodiment of the present invention will be discussed.

Firstly, the burner 13 of the treater 10 is ignited to heat the combustion chamber 12 up to an appropriate temperature, and simultaneously the door 11*a* is opened to pour combustible wastes through the inserting hole 111 into the combustion chamber 12. Then, the pump 21 of the supplier 20 operates to convey the waste water collected within the collecting tank 201 to the separating tank 52 of the separator 50.

At the time, the separating rollers 53 and 53' of the separator 50 are rotated by the driving of the motor 536, and the power of the cores 532 and 532' and the coils 533 and 533' mounted in the separating rollers 53 and 53' is conductive. As a result, since the separating roller 53 becomes an electromagnet having a positive (+) magnetic force and the separating roller 53' becomes an electromagnet having a negative (−) magnetic force, the sludge contained within the waste water is electrically separated by the magnetic force thereof and is attached on the outer peripheral surfaces of the separating rollers 53 and 53'.

While the separating rollers 53 and 53' are continually rotated, since the inner ends of the blades 54 and 54' are in almost contact with the outer peripheral surface of the separating rollers 53 and 53', the sludge attached on the outer peripheral surfaces of the separating rollers 53 and 53' is scratched by the inner ends of the blades 54 and 54' and passes through the upper surface thereof to be dropped within the collecting tank 51.

At the time, the sludge separatedly collected from the waste water 538 is directly delivered to the combustion chamber 12 through the outflowing hole 511 and the supplying pipe 512 of the bottom surface of the collecting tank 51 and is immediately burned by a high temperature of fire of the burner 13.

The low density of waste water from which the sludge particles are separated and removed flows within the heat exchanger 60 through the outflowing hole 522 and the conveying pipe 22*a.*

At the time, since the heat exchanger 60 is heated by the heat of the exhaust gas ejected to the interior of the dust collector 40 through the chimney 114 from the treater 10, the low density of waste water within the heat exchanger 60 is heat-exchanged with the exhaust gas and heated.

Next, the heated waste water is delivered to the storage tank 23 through the outflowing hole 62 and the conveying pipe 22*b,* and the waste water in the storage tank 23 is delivered to the receiving pipe body 31 of the ejector 30 and is ejected within the combustion chamber 12 through the nozzles 32.

Since the low density of waste water is in a heated state within the heat exchanger 60, the water and the sludge remaining can be rapidly evaporated and burned within the combustion chamber 12.

On the other hand, in the second embodiment of the present invention the waste water is delivered to the heat exchanger 60 through the separator 50, but may be delivered from the separator 50 to the ejector 30, not passing through the heat exchanger 60, which is not of course deviated from the scope of the invention.

Furthermore, all operations of the first and second embodiments of the present invention are automatically controlled by a general automatic control apparatus (not shown).

Industrial Applicability

As apparent from the foregoing, a waste water treating device constructed according to the present invention can rapidly evaporate waste water in which waste water or oil printing ink, or waste oil such as lubricating oil, cutting oil and so on is contained in a treater and completely destroys by fire sludge contained in the waste water, to thereby eliminate an environment contamination problem caused due to the factory waste water.

In addition, a waste water treating device constructed according to the present invention can be simply installed in a small area and destroy combustible wastes and sludge to reduce fuel consumption cost of a burner. Moreover, a waste water treating device constructed according to the present invention can increase a treating amount of the waste water per unit time to thereby reduce an activation time thereof and decrease installation and maintenance cost, to thereby obtain an economic advantage.

What is claimed is:

1. A waste water treating device comprising:

a combustion chamber having an inlet passage by which combustible wastes of waste water and sludge are inserted into the combustion chamber, a burner for burning the wastes while evaporating waste water and incinerating the sludge within a waste incineration part of the combustion chamber, an outlet for taking ashes out of the combustion chamber and a gas outlet for discharging combustion gas from the combustion chamber;

a waste water supplier for supplying the waste water from a collecting tank into the combustion chamber having:

a pump for the collecting tank, a storage tank for temporarily storing the waste water supplied from the waste water collecting tank by said pump prior to injecting the waste water into said combustion chamber, and an ejector for discharging the waste water from said supplier into said combustion chamber through a plurality of nozzles;

a dust collector including:

an exhaust pipe for exhausting the combustion gas from said combustion chamber gas outlet into the atmosphere, and a dust treating and collecting chamber for collecting and treating dust from the combustion gas before the combustion gas is discharged from the exhaust pipe into the atmosphere; and a sludge separator installed at a position between said supplier and said ejector for electrically separating the sludge from the waste water prior to directly feeding the sludge into the combustion chamber and feeding the diluted waste water to said ejector, said sludge separator comprising:

a collecting tank connected to an upper end of a supplying pipe at its bottom wall, with a lower end of said supplying pipe being positioned within said combustion chamber;

a separating tank mounted within said collecting tank and connected to a conveying pipe of said supplier at its sidewall and to a diluted waste water conveying pipe at its bottom wall;

a plurality of separating rollers rotatably mounted within an upper portion of said separating tank with a part of said separating rollers to be immersed in the waste water of said separating tank, said separating rollers being selectively turned on so as to become electromagnets capable of attracting the sludge thereon; and a plurality of blades for scraping the sludge-on said separating rollers prior to dropping the sludge into said collecting tank, said blades being inclinedly mounted to an upper portion of said separating tank at opposite positions in a way such that each blade is inclined downwardly from an inside end to an outside end thereof, with the inside end being positioned close to an associated separating roller and the outside end being positioned within said collecting tank.

2. The waste water treating device according to claim 1, further comprising:

a heat exchanger installed at a position between said supplier and said ejector, said heat exchanger being adapted for heating the waste water from the supplier using the combustion gas from said dust collector, thus allowing the waste water to be preheated to a desired temperature prior to being fed to said ejector.

3. The waste water treating device according to claim 2, wherein said heat exchanger comprises a cylindrical body, provided with a waste water inlet hole and a waste water outlet hole and installed within an upper portion of said dust collector.

4. The waste water treating device according to claim 1, wherein a plurality of guide projections are interiorly provided on a sidewall of the combustion chamber at alternate positions.

5. The waste water treating device according to claim 1 wherein said plurality of nozzles are provided on a sidewall of the combustion chamber with a pair of nozzles placed at opposite positions with water ejecting directions of the nozzles crossing each other.

* * * * *